US006908010B2

(12) United States Patent
Shinmachi et al.

(10) Patent No.: US 6,908,010 B2
(45) Date of Patent: Jun. 21, 2005

(54) DRIVEN ROTARY BODY, SHEET MATERIAL CONVEYING APPARATUS, AND RECORDING APPARATUS

(75) Inventors: Masaya Shinmachi, Kanagawa-ken (JP); Yasutsugu Saijo, Tokyo (JP); Tetsuhiro Nitta, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/454,467

(22) Filed: Jun. 5, 2003

(65) Prior Publication Data

US 2004/0007810 A1 Jan. 15, 2004

(30) Foreign Application Priority Data

Jun. 7, 2002 (JP) ..... 2002/166628

(51) Int. Cl.[7] ..... B65H 5/00
(52) U.S. Cl. ..... 221/264
(58) Field of Search ..... 271/264; 492/38; 39/492

(56) References Cited

U.S. PATENT DOCUMENTS

| | | | | | |
|---|---|---|---|---|---|
| 5,567,069 | A | | 10/1996 | Suzuki et al. | |
| 5,672,019 | A | * | 9/1997 | Hiramatsu et al. | 400/624 |
| 5,773,109 | A | * | 6/1998 | Kubo et al. | 428/36.9 |
| 6,027,211 | A | * | 2/2000 | Unosawa et al. | 347/104 |
| 6,523,929 | B2 | | 2/2003 | Kan et al. | |

* cited by examiner

*Primary Examiner*—Donald P. Walsh
*Assistant Examiner*—Kenneth W Bower
(74) *Attorney, Agent, or Firm*—Fitzpatrick, Cella, Harper & Scinto

(57) ABSTRACT

The present invention relates to a driven rotary body rotating in pressure contact with and driven by a conveyance rotary body. The driven rotary body includes a shaft portion molded from a resin as an integral body, a recess positioned around a center in a longitudinal direction for parting a mold horizontally in the longitudinal direction of the driven rotary body and a roller portion positioned on each side of the recess.

11 Claims, 7 Drawing Sheets

DRIVEN ROTARY BODY, SHEET MATERIAL CONVEYING APPARATUS, AND RECORDING APPARATUS

BACKGROUND OF THE INVENTION

1. Field of the Invention

This invention relates to a driven rotary body rotating due to pressurized contact with a conveyance rotary body and driven by this conveyance rotary body and, e.g., to a pinch roller in pressurized contact with a conveyance roller as a driven rotary body, a sheet material conveying apparatus having the pinch roller, and a recording apparatus having the sheet material conveying apparatus.

2. Description of Related Background Art

In apparatuses such as printers, photocopiers, and facsimile machines, sheet materials stacked on a sheet material stacking section are separately fed sheet by sheet to effect recording on the sheet materials or to read original documents, and after the front ends of the sheet materials separated at the sheet material conveying section are aligned, the sheet materials are conveyed to a recording reading area.

FIG. 5 is a perspective view showing a conveyance portion of a conventional conveying apparatus; FIG. 6 is a structural cross-sectional view for illustrating a structure of a sheet material conveyance portion of the conventional conveying apparatus.

The sheet material separately conveyed from a feeding apparatus (not shown) is so aligned as to arrange the front end thereof at a conveyance portion 110 with a conveyance roller 111 and a pinch roller 104 in pressure contact with the conveyance roller 111.

The sheet material with the aligned front end is transmitted to a recording portion 130 by the conveyance roller 111, and a recording head 132 records where the sheet material is supported at a platen 131.

The recorded sheet material is delivered to the exterior of the apparatus through a delivery portion 140 formed of at least one delivery roller 141 and corresponding delivery spur 142.

The conveyance roller 111 is a metal roller having a sheet material conveyance surface on which ground particles are coated, and the pinch roller 104 is formed of a molded resin such as POM (polyoxymethylene).

The pinch roller 104 has a hole opened in a longitudinal direction, is supported by a pinch roller holder 102 attached rotatably to a body chassis 101 where a metal shaft 105 is penetrated through the hole, and is in pressure contact with the conveyance roller 111 by a pinch roller spring 103.

FIG. 7 shows a shape of the pinch roller 104 in the conventional apparatus as described above.

The pinch roller 104, in which the hole is opened as to receive the metal shaft as shown in FIG. 7(*a*), is formed by parting the mold around one end of the roller in the longitudinal direction as shown in FIG. 7(*b*). That is, as shown in FIG. 7(*b*), the pinch roller 104 is molded in a shape as shown in FIG. 7(*a*) with molds 151, 152 respectively extending in the longitudinal direction and being parted at a partition line PL around the one end of the roller in the longitudinal direction.

A surface of the pinch roller 104 is necessarily to be molded with as few scratches as possible to prevent damage from occurring on the sheet material, and the diameter of the center portion is necessarily larger than each end to prevent scratching the sheet material by opposite ends of the pinch roller in the longitudinal direction. That is, where the pinch roller diameters at positions (1), (2), (3) in FIG. 7(*a*) are $\phi A \pm a$, $\phi B \pm b$, and $\phi C \pm c$, the relation among those diameters is $B-b>A+a$, and $A=C$. As shown in FIG. 7(*a*), length D of the conventional pinch roller 104 in the longitudinal direction is about 20 mm.

To the contrary, in a case where the metal shaft is eliminated for cost reduction, where the pinch roller is molded as an integral body to reduce the unit price, and where the length of each roller is made longer to reduce the number of the pinch rollers, the length of the mold for molding the roller may become longer in a longitudinal direction by an extended portion of the roller with a molding method in which the molds are parted at one side in the longitudinal direction of the roller in substantially the same way as in the conventional method.

Therefore, problems arise not only in that the production of the mold becomes difficult, but also in that the molding cycle for the roller becomes longer due to cooling of the mold, that accurate sizes tend not to be obtained during molding, and that defects tend to occur, and consequently, the advantages of the cost reduction may be nullified.

If the above problems could be solved by using particular resin materials, the valuable advantages of cost reduction may not be adequately achieved due to costs and availability of the materials or the like.

SUMMARY OF THE INVENTION

This invention is made in consideration of the problems in the prior art as described above, and it is an object to provide a pinch roller that can be molded without any difficulty with an ordinary molding method and ordinary materials even where the pinch roller is molded as an integral body and formed in an extended shape.

A representative structure of a drive rotary body of the invention for accomplishing the above objects is as follows: a driven rotary body rotating in pressure contact with and driven by a conveyance rotary body, said drive rotary body comprising: a shaft portion molded from a resin in a united body; a recess for parting a mold in the longitudinal direction of the driven rotary body; and a roller portion positioned on each side of the recess.

A structure of a representative sheet material conveying apparatus according to the invention to accomplish the above objects includes: a conveyance roller for conveying a sheet material; a pinch roller driven by the conveyance roller to rotate, the pinch roller having a shaft portion molded from a resin in a united body, a recess for parting a mold in the longitudinal direction of the driven rotary body, and a roller portion positioned on each side of the recess, a pinch roller holding means for holding the pinch roller; and a pressing means for contacting the pinch roller to the conveyance roller with pressure.

As described above, according to the invention, with the drive rotary body rotating in pressure contact with and driven by a conveyance rotary body, the length of the molds for the driven rotary body can be shortened by providing the recess for parting the molds in the longitudinal direction of the driven rotary body. Therefore, where the bearing is molded with a resin in a united body to extend the length of the driven rotary body in the longitudinal direction, the rotary body does not worsen the molding cycle for cooling the molds and can effect excellent molding without using any particular material, so that the production costs thereof can be reduced.

DETAILED DESCRIPTION OF THE PREFERRED EMBODIMENTS

Figure 1:
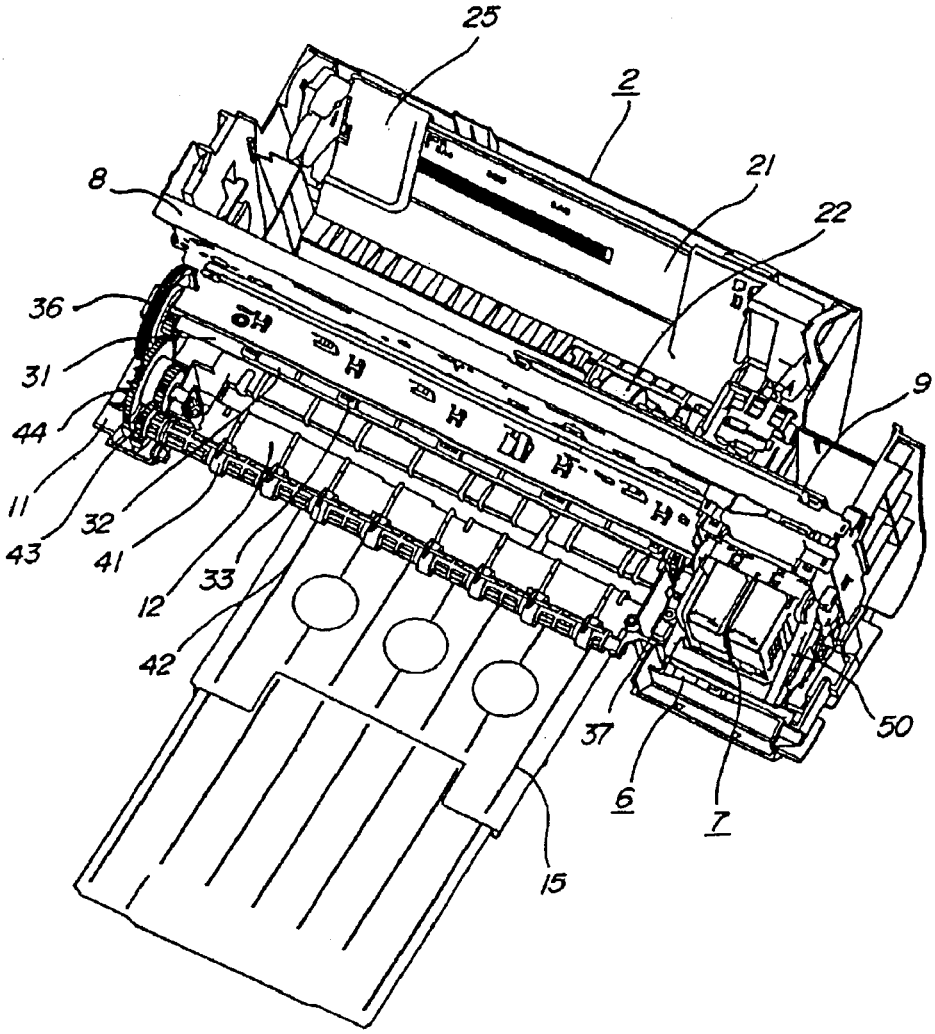
FIG. 1 is a perspective view showing the entire structure of a recording apparatus in a first embodiment.

Hereinafter, referring to the drawings, preferred embodiments of the invention are described in detail in an exemplifying manner. The sizes, materials, shapes, and correlative positions of structural parts as set forth in the embodiments below can be modified properly according to the apparatus structure to which this invention applies and to various conditions and terms, and if there is no specific description, the scope of this invention is not intended to be limited.

First Embodiment

Figure 2:
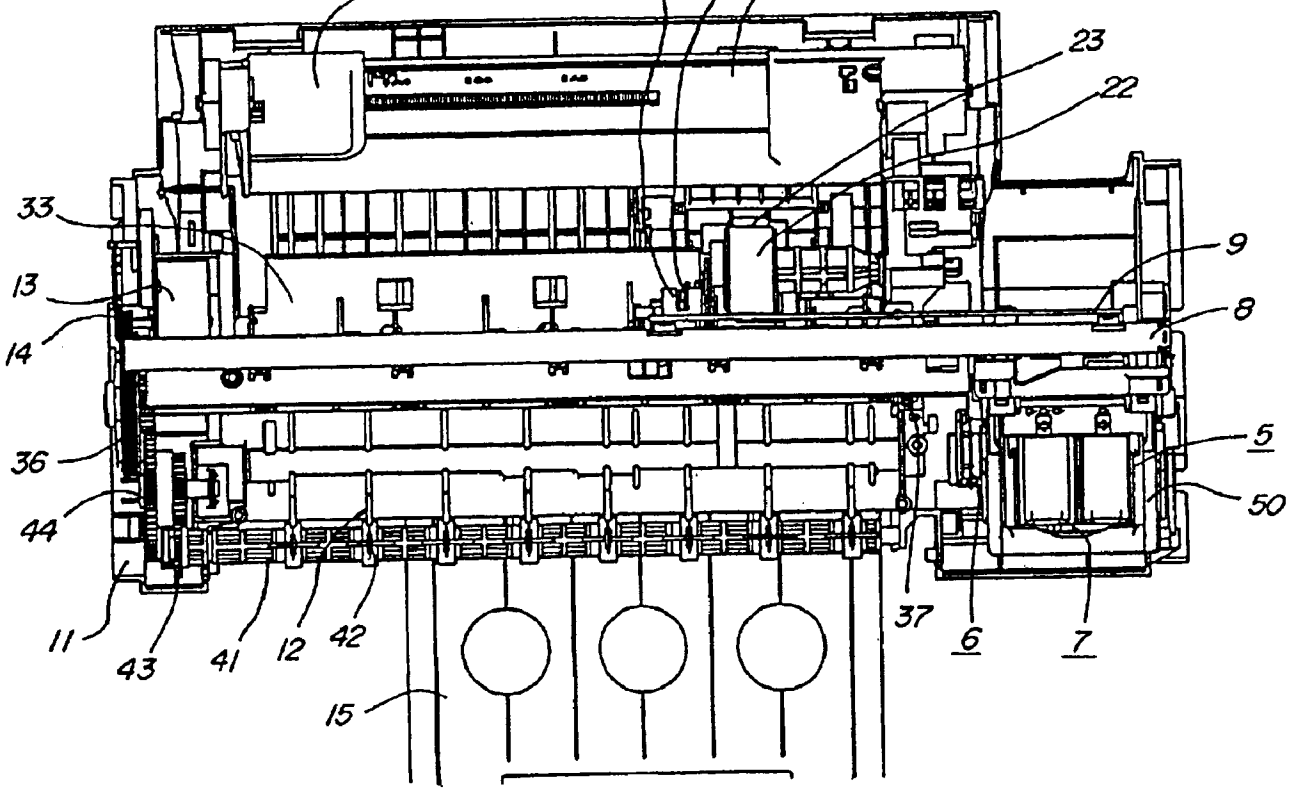
FIG. 2 is a top view of the recording apparatus shown in FIG. 1.

Hereinafter, the first embodiment of the invention is described with reference to the drawings. FIG. 1 is a perspective view showing the entire structure of a recording apparatus in a first embodiment; FIG. 2 is a top view of the recording apparatus shown in FIG. 1; and FIG. 3 is a structural cross-sectional view of the recording apparatus shown in FIG. 1.

Figure 3:
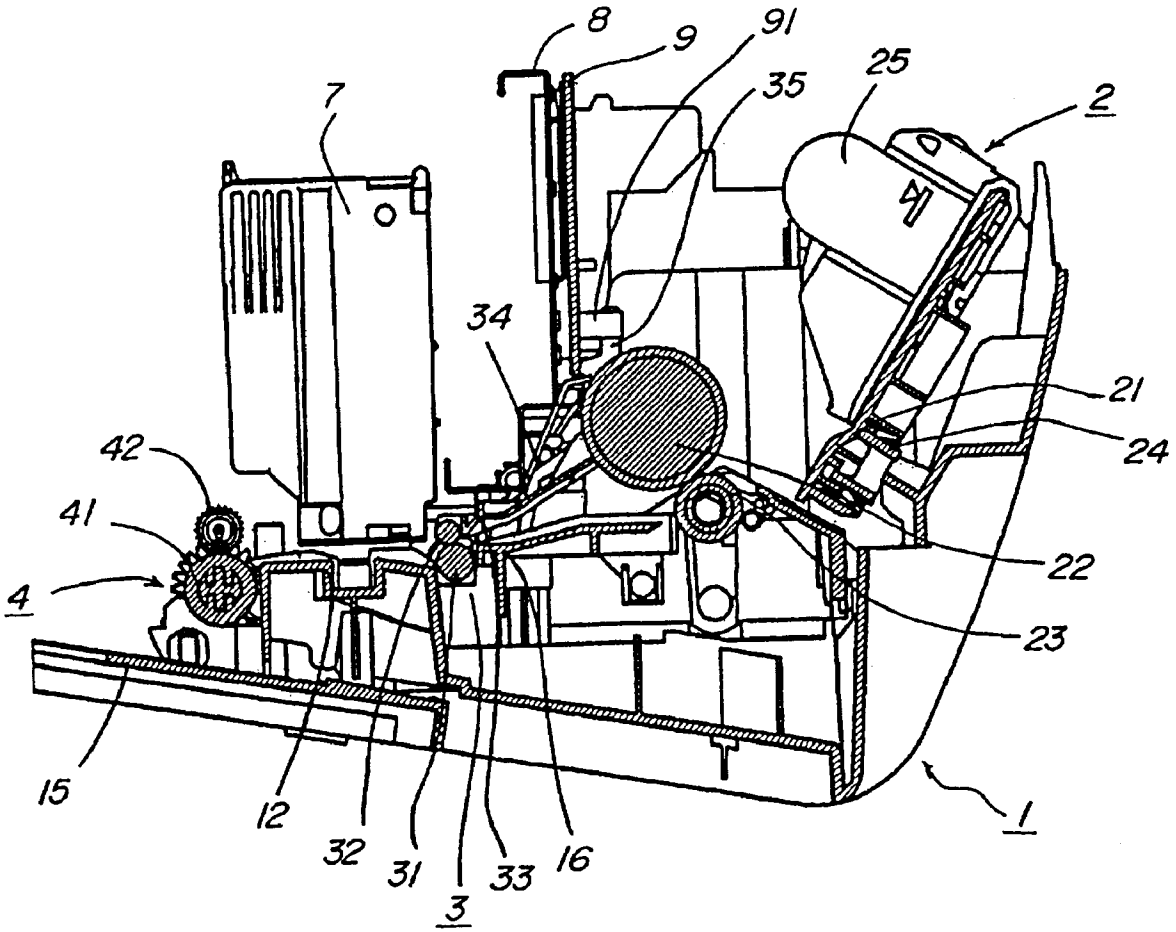
FIG. 3 is a structural cross-sectional view of the recording apparatus shown in FIG. 1.

As shown in FIGS. 1–3, a recording apparatus 1 includes a feeding unit 2 for stacking and separately feeding sheet materials as recording media, a conveyance unit 3 for conveying the fed sheet materials, a delivery unit 4 for delivering the sheet materials to the exterior of the recording apparatus, a carriage unit 5 on which a recording head is mounted for recording on the sheet materials, and a cleaning unit 6 for cleaning the recording head. Hereinafter, the structure of the respective units and their operation will be described.

The feeding unit 2 is rotatably attached to a base 11 around a rotary shaft as a center. The feeding unit 2 is constituted of a pressure plate 21 stacking the sheet materials serving as recording media, a pair of a feeding roller 22 and a separation roller 23 for separately feeding the stacked sheet materials sheet by sheet, a pressure plate spring 24 urging the pressure plate 21 to the feeding roller 22, and a movable side guide 25 limiting the stacking position of the sheet materials in the lateral direction.

During a waiting state, the pressure plate 21 is pushed down by a cam or the like (not shown) to a prescribed position, and this disengages the contact between the pressure plate 21 and the feeding roller 22.

During the feeding operation, the pressure plate 21 is lifted by the cam or the like (not shown) to contact the feeding roller 22 with the sheet material, and the sheet material is conveyed according to the rotation of the feeding roller 22 to be sent to the conveyance unit 3 after being separated sheet by sheet with the feeding roller 22 and the separation roller 23.

The conveyance unit 3 includes a conveyance roller 31 as a conveyance rotary body for conveying the sheet materials, a pinch roller 32 formed in contact with the conveyance roller 31 for serving as a driven rotary body driven by the conveyance roller 31, a pinch roller holder 33 attached rotatably to a chassis serving as a holding means, a pinch roller spring 34 as a pushing means for urging the pinch roller 32 in pressing contact with the conveyance roller 31, and a PE sensor lever 35 attached rotatably to the pinch roller holder 33 for detecting the front and rear ends of the sheet materials.

The conveyance roller 31 rotates upon receipt of the drive of a conveyance motor 13 via a motor gear 14 as well as via a conveyance gear 36 secured to the conveyance roller 31. An output gear 37 is secured on the opposite side of the secured portion of the conveyance gear 36 of the conveyance roller 31 for transmitting drive of the conveyance motor 13 to the conveyance unit 2.

The sheet material sent to the conveyance unit 3 is guided on a guide surface 16 of the base 11 and a lower surface of the pinch roller holder 33, sent to a roller pair of the conveyance roller 31 and the pinch roller 32, and conveyed to a downstream side of the conveyance roller 31 after the front end of the sheet material is aligned.

The PE sensor lever 35 is moved pivotally by the front end of the sheet material midway of the above operation, and the front end of the sheet material is detected upon operation of a PE sensor 91 formed on an electric substrate 9 secured to the chassis 9. From the detected result, the conveyed amount of the sheet material can be determined up to the position for beginning the recording.

The sheet material conveyed to the downstream side of the conveyance roller 31 is subject to image formation with a recording head 7 mounted on the carriage 50 while the sheet material is guided on a platen surface 12 formed on the base 11.

The delivery unit 4 is constituted of a delivery roller 41 for conveying the sheet materials sent from the conveyance unit 3, a delivery spur driven rotatably by the delivery roller 41, and a delivery idling gear 44 for transmitting the drive from the conveyance motor 13 to a delivery gear 43 formed at the delivery roller 41.

The sheet material formed with images is conveyed by being sandwiched between the delivery roller 41 and the delivery spur 42 and delivered onto a delivery tray 15.

Figure 4:
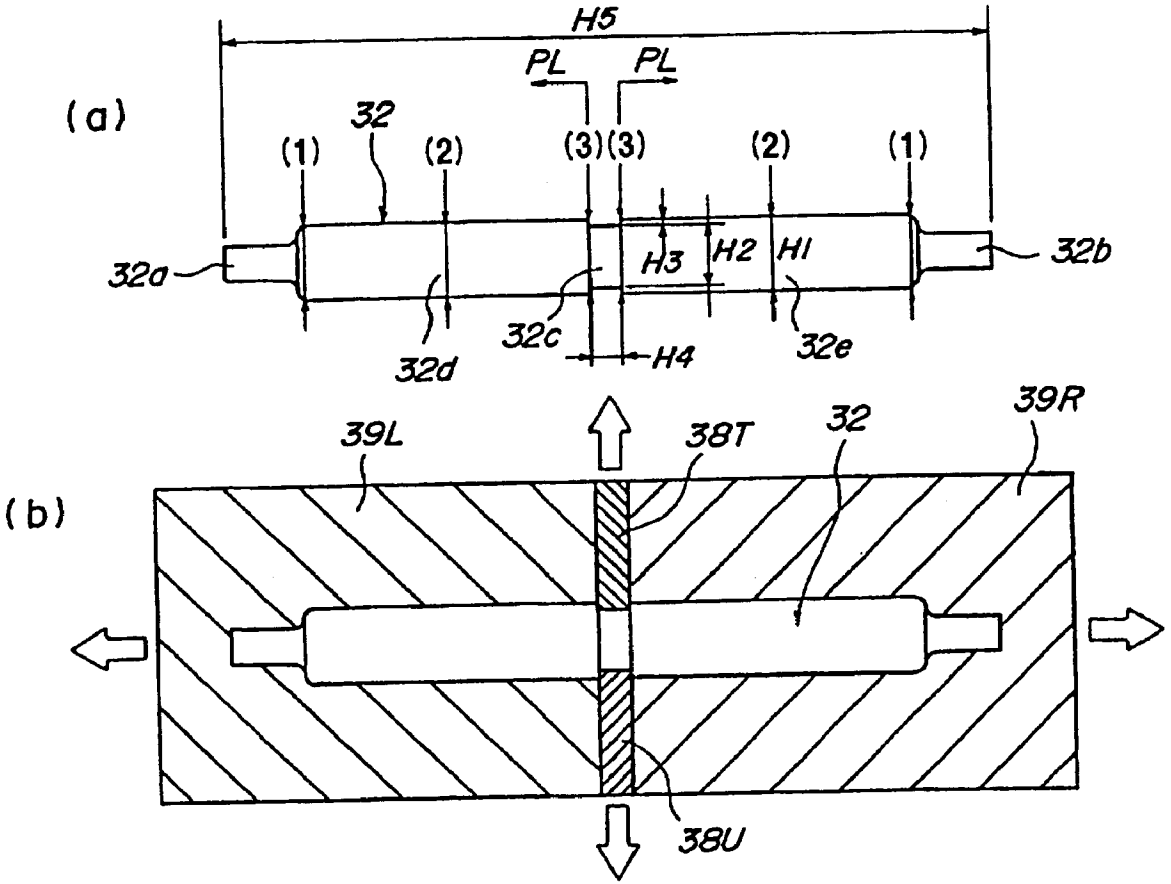
FIG. 4 is an illustration showing a pinch roller of the recording apparatus shown in FIG. 1.
Figure 5:
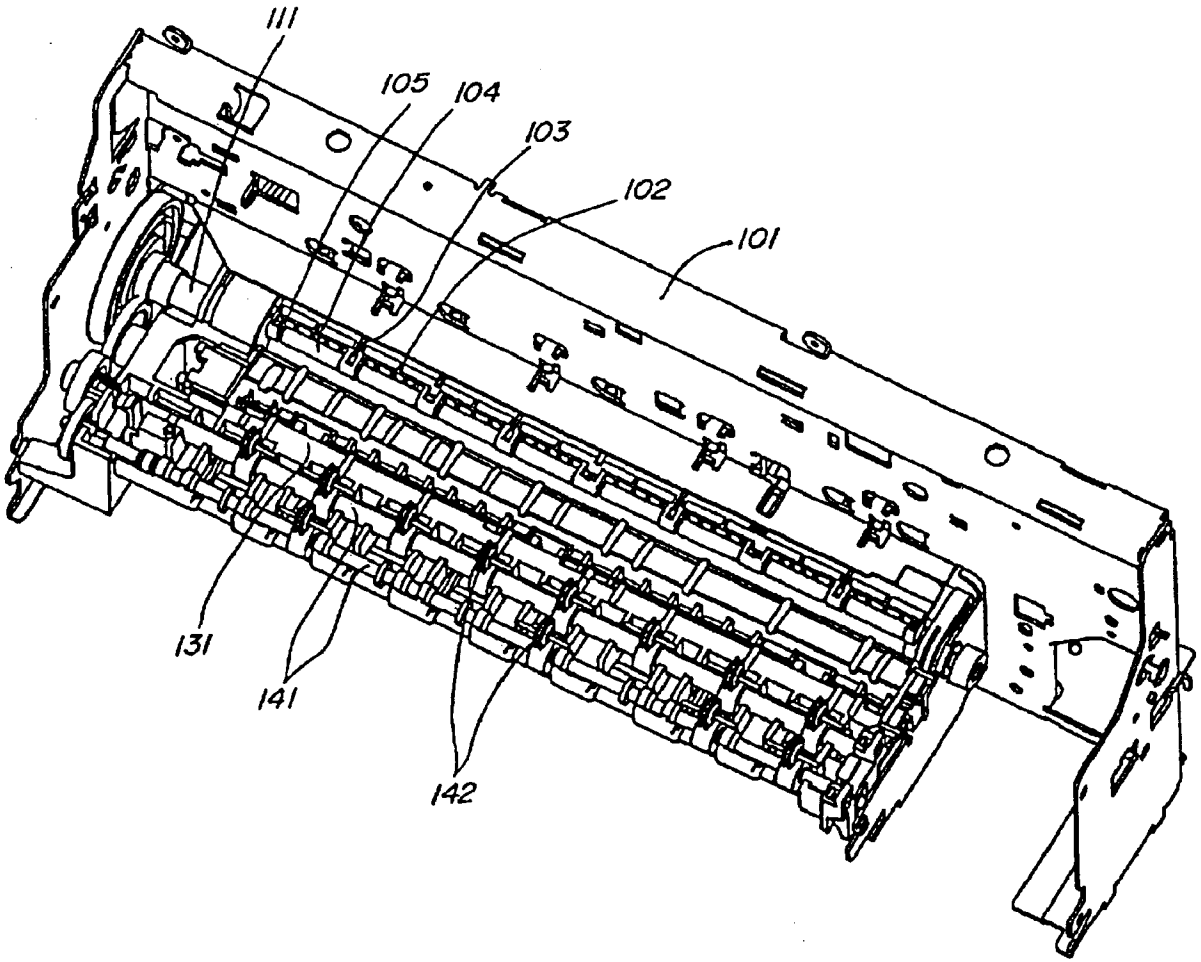
FIG. 5 is a perspective view showing a conveyance unit of a conventional conveying apparatus.
Figure 6:
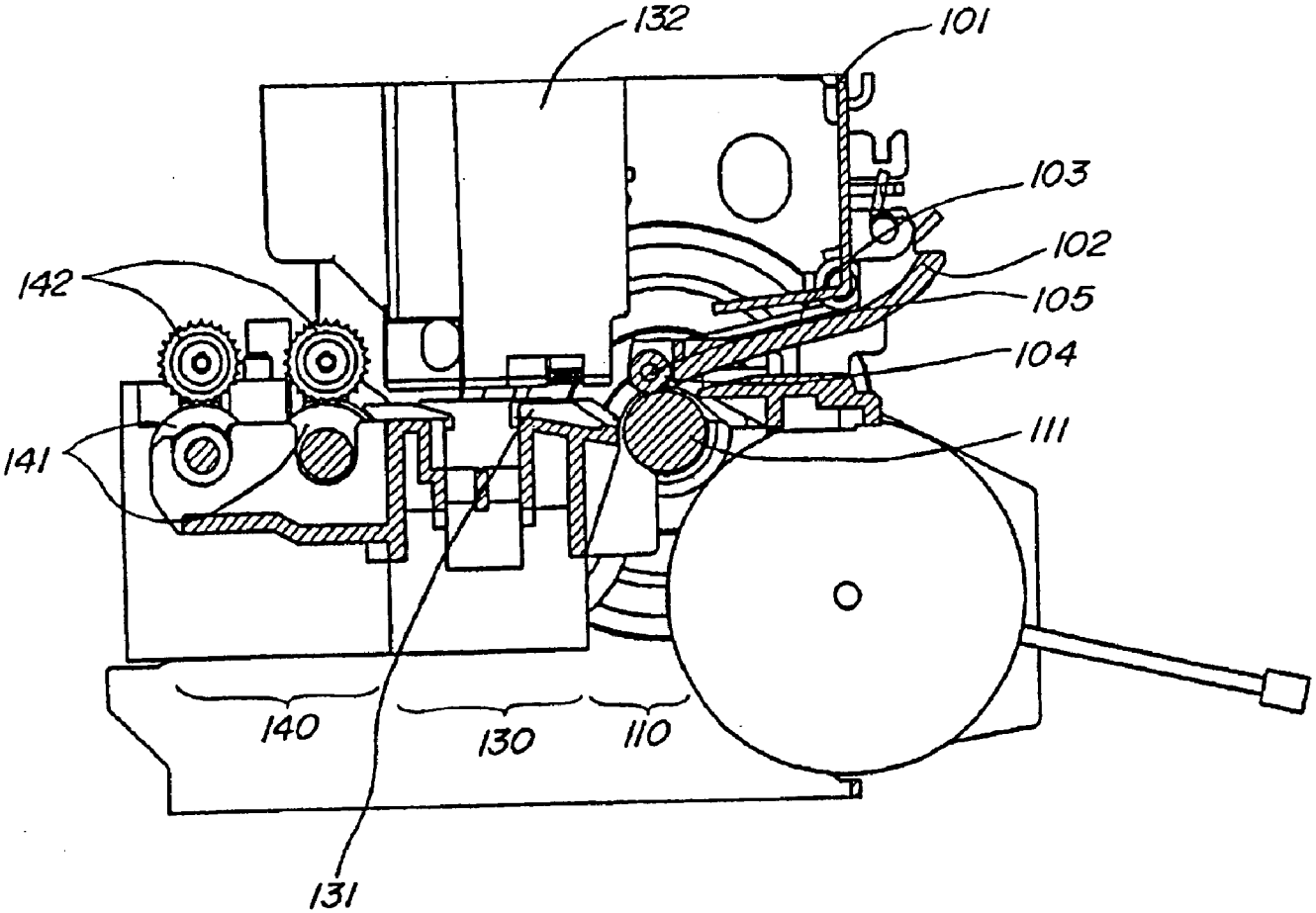
FIG. 6 is a structural cross-sectional view illustrating a structure of a sheet material conveying unit of the conventional conveying apparatus.
Figure 7:
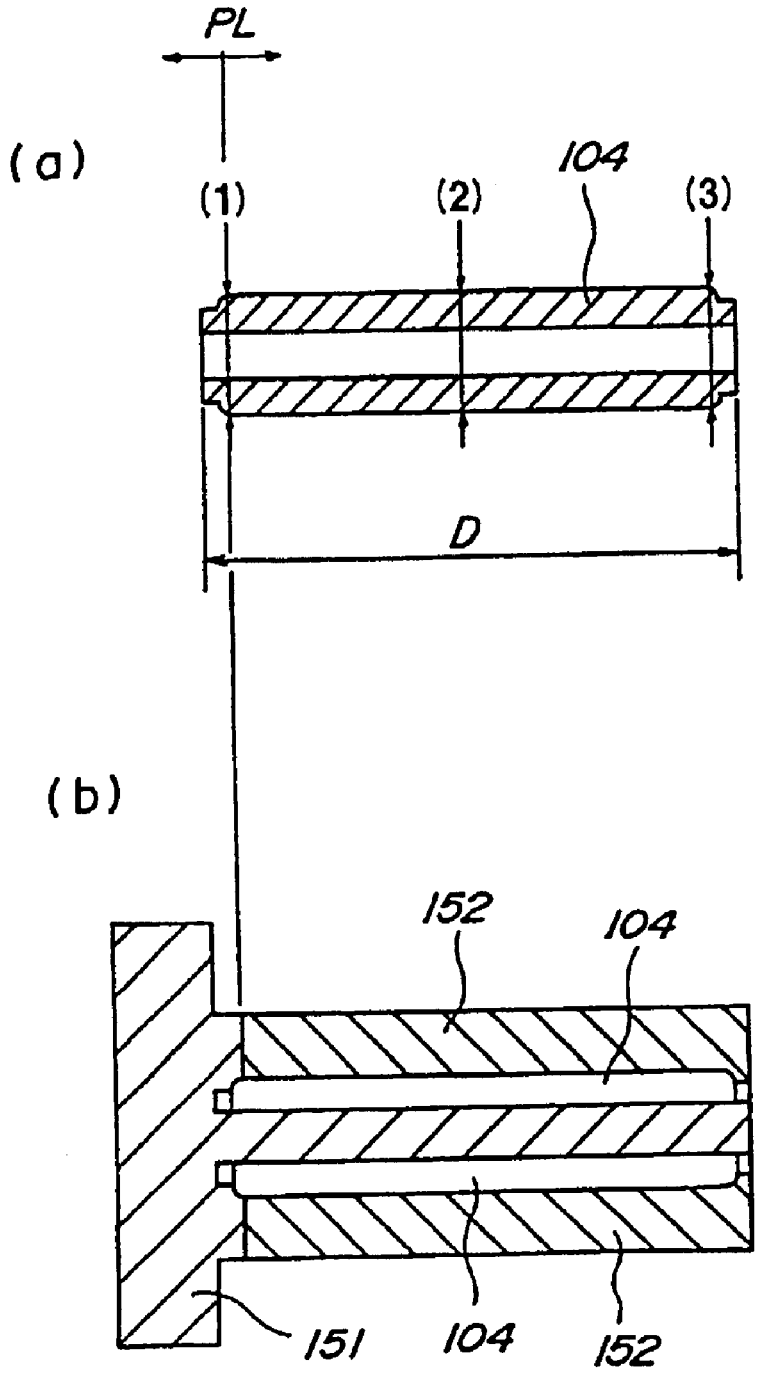
FIG. 7 is an illustration showing a conventional pinch roller.

Next, the pinch roller as the driven rotary body according to the embodiment is described. FIG. 4 is an illustration showing the pinch roller according to this embodiment.

The pinch roller 32 as the driven rotary body driven to rotate by pressure contact with the conveyance roller 31 as the conveyance rotary body is molded of a resin with pinch roller bearings 32*a*, 32*b* to form a united body.

The pinch roller 32 is supported on a pinch roller holder 33 (see FIG. 3) as a holding means with the pinch roller bearings 32*a*, 32*b*, pressed with the pinch roller spring 34 (see FIG. 3) as a pushing means and urged to the conveyance roller 31.

In this embodiment, as shown in FIG. 3, four of the pinch rollers 32 are arranged to be extending in a width direction substantially perpendicular to the sheet material conveyance direction, and each pinch roller spring 34 urges the pinch roller 32 at five locations around the bearings of the pinch roller holders 33. The urging forces from the respective pinch roller springs 34 is designed such that the relation among those urging forces becomes $\beta=2\alpha$ where the force is denoted as $\alpha$ at two locations of the opposite ends of the four pinch rollers thus arranged and as $\beta$ at three other locations.

A recess 32*c* is formed at a center in the longitudinal direction of the pinch roller 32, and when molded, the molds are parted horizontally in the longitudinal direction at a portion of the recess 32*c*. More specifically, as shown in FIG. 4(*b*), in this embodiment, regarding the pinch roller 32, two molds 38T, 38U parting vertically with respect to the longitudinal direction form the recess 32*c*, and two molds 39L, 39R parting horizontally in the longitudinal direction at a parting line PL with respect to the molds 38T, 38U form roller portions 32*d*, 32*e* located on the respective sides of the recess. Those molds form the recess 32*c* and mold the pinch roller 32 as shown in FIG. 4(*a*) extending in the axial direction with which the bearings 32*a*, 32*b* are molded in a united body.

Thus, the recess 32*c* is formed at the center in the longitudinal direction of the pinch roller 32, and the molds 39L, 39R are divided horizontally at a portion (parting line PL) of the recess 32*c*, thereby rendering short the length of the mold for the roller in the longitudinal direction even where a roller elongated in the longitudinal direction is molded. Therefore, even where the length of the pinch roller 32 in the axial direction is extended where the bearings 32*a*, 32*b* are molded in the united or integral body to the roller, the molding cycle for cooling the molds is not worsened, and the molding can be performed in a good shape with a resin such as POM (polyoxymethylene) used conventionally without using any particular material, so that cost reduction can be achieved.

The recess 32*c* of the pinch roller 32 is made wider in a direction from the rotary center to the roller outer periphery. This is not only for parting the molds 39*a*, 39*b* horizontally in the longitudinal direction as shown in FIG. 4(*b*) at the boundary of a portion (parting line PL) of the recess 32*c*, but also for preventing the molds 38T, 38U at a portion of the recess 32*c* from not releasing in the vertical direction with respect to the longitudinal direction.

Regarding the pinch roller 32, the outer diameter of the recess 32*c* is smaller than the outer diameter of the roller portion. More specifically, the outer diameters of the opposite ends of the recess 32*c* are smaller than the outer diameters around the center of the roller portions 32*d*, 32*e* located on both sides of the recess. That is, as shown in FIG. 4(*a*), in one pinch roller 32, the right and left roller portions 32*d*, 32*e* astride the recess 32*c* satisfy the diameter relations of $B-b>A+a$ and $A=C$, where the roller diameters at positions (1), (2), (3) are $\phi A\pm a$, $\phi B\pm b$, and $\phi C\pm c$.

It is to be noted that in this embodiment as shown in FIG. 4(*a*), diameter H1 of the roller portions 32*d*, 32*e* of the pinch roller 32 is about 5 mm; diameter H2 of the recess 32*c* is about 4 mm; depth H3 of the recess 32*c* is about 0.5 mm; width H4 in the axial direction of the recess 32*c* on a side of the roller outer peripheral surface is about 2 mm; and length H5 in the longitudinal direction of the entire pinch roller molded as an integral body is about 48 to 50 mm.

Other Embodiments

Although in the embodiment described above the pinch roller driven to rotate in pressure contact with the conveyance roller for conveying the sheet materials is exemplified as a driven rotary body driven to rotate in pressure contact with a conveyance rotary body, the invention is not limited to this, and is properly applicable according to demands.

Although in the embodiment described above the kind and number of the recording heads are not exemplified specifically, the invention is applicable, notwithstanding the kind and number of the recording heads, to any apparatus such as an inkjet recording apparatus using a single recording head, a multicolor inkjet recording apparatus using multiple recording heads in which inks of different colors effect recording, and a grayscale-type inkjet recording apparatus using plural recording heads in which inks of the same color but different densities effect recording, so that the advantages described above can be achieved.

As a recording means (recording head), any structure of the recording means and the ink tank, such as a structure of a cartridge type in which a recording head and an ink tank are united, or a structure in which a recording head and an ink tank are separated and connected via an ink supplying tube, is applicable in substantially the same way, and substantially the same advantages can be obtained.

Where this invention is applied to an inkjet recording apparatus, this invention is applicable to a structure using a recording means using, e.g., an electro-mechanical converter such as a piezo device or the like, and, inter alia, an excellent advantage can be achieved by an inkjet recording apparatus using recording means of an ink discharging method utilizing thermal energy. With this method, recording is achieved with high density and high definition.

Furthermore, this invention is effectively applicable to a recording head of a full line type having a length corresponding to the maximum width of the recording medium on which the recording apparatus can record. As such a recording head, either of a structure satisfying the length in combination of plural recording heads or a structure of a sole recording head formed as a united body can be used. In addition, even in the serial type described above, this invention is advantageous when using a recording head secured to the apparatus body, a recording head of a replaceable chip type in which ink can be supplied from the apparatus body and in which electrical connection is made when attached to the apparatus body, or a recording head of a cartridge type in which an ink tank is formed in a united body with the recording head itself.

As a system of the inkjet recording apparatus described above, this invention is applicable not only to an apparatus used as an image output terminal apparatus of an information processing apparatus such as a computer, but also to such as an inkjet input/output apparatus capable of attaching a scanner or the like rather than the recording head on the carriage, a photocopier in combination with a reader and the like, and a facsimile machine having a transmitting and receiving function.

In the embodiment described above, the inkjet recording method is exemplified as the recording method, but this invention is not limited to this. This invention is applicable to a thermal transfer method, a thermosensitive recording method, an impacting recording method such as a wire dot recording method, and other recording methods such as electrophotographic methods.

What is claimed is:

1. A driven rotary body rotating in pressure contact with and driven by a conveyance rotary body, said driven rotary body comprising:

a shaft portion molded from a resin in a united body;

a recess formed by a mold that parts in a direction transverse to the axial direction of the driven rotary body; and a roller portion positioned on each side of the recess.

2. The driven rotary body according to claim 1, wherein the driven rotary body is molded with two molds parting vertically with respect to the axial direction of the driven rotary body to mold the recess, and two molds parting in the axial direction of the driven rotary body to mold the roller portion.

3. A sheet material conveying apparatus comprising:

a conveyance roller for conveying a sheet material;

a pinch roller driven by the conveyance roller to rotate, the pinch roller comprising a shaft portion molded from a resin in a united body, a recess formed by a mold that parts in a direction transverse to the axial direction of the pinch roller, and a roller portion positioned on each side of the recess;

pinch roller holding means for holding the pinch roller; and pressing means for pressing the pinch roller against the conveyance roller with pressure.

4. The sheet material conveying apparatus according to claim 3, wherein an outer diameter of the recess is smaller than the outer diameter of the roller portion.

5. The sheet material conveying apparatus according to claim 3, wherein the pinch roller is molded with two molds parting vertically with respect to the axial direction of the pinch roller to mold the recess, and two molds parting horizontally in the axial direction of the pinch roller to mold the roller portion.

6. A recording apparatus comprising:

a recording unit for recording on a recording medium; and a sheet material conveying apparatus as set forth in any one of claims 3 to 5 for conveying the recording medium.

7. The recording apparatus according to claim 6, wherein the recording unit records with a recording means for discharging ink in correspondence with a signal.

8. The recording apparatus according to claim 7, wherein the recording unit discharges ink by thermal energy generated by an electro-thermal converter, wherein the recording means electrically drives the electro-thermal converter in response to the signal.

9. The driven rotary body according to claim 1, wherein the recess is positioned around a center with respect to the axial direction of the driven rotary body.

10. The driven rotary body according to claim 1, wherein an outer diameter of the recess is smaller than the outer diameter of the roller portion.

11. The sheet material conveying apparatus according to claim 3, wherein the recess is positioned around a center with respect to the axial direction of the pinch roller.

* * * * *